US011382408B2

(12) United States Patent
Chu

(10) Patent No.: US 11,382,408 B2
(45) Date of Patent: Jul. 12, 2022

(54) HAIR BRUSH STRUCTURE

(71) Applicant: Peng-Fei Chu, Taipei (TW)

(72) Inventor: Peng-Fei Chu, Taipei (TW)

( * ) Notice: Subject to any disclaimer, the term of this patent is extended or adjusted under 35 U.S.C. 154(b) by 265 days.

(21) Appl. No.: 16/897,528

(22) Filed: Jun. 10, 2020

(65) Prior Publication Data

US 2021/0007472 A1 Jan. 14, 2021

(30) Foreign Application Priority Data

Jul. 10, 2019 (CN) ..... 201910619586.2

(51) Int. Cl.

| | |
|---|---|
| ***A46B 7/02*** | (2006.01) |
| ***A46B 5/00*** | (2006.01) |
| ***A46B 9/02*** | (2006.01) |
| ***A46B 9/10*** | (2006.01) |

(52) U.S. Cl.

CPC ..... *A46B 5/0025* (2013.01); *A46B 5/0037* (2013.01); *A46B 7/02* (2013.01); *A46B 9/023* (2013.01); *A46B 9/025* (2013.01); *A46B 9/10* (2013.01); *A46B 2200/104* (2013.01)

(58) Field of Classification Search

CPC ..... A46B 5/0025; A46B 5/0033; A46B 7/02; A46B 9/10; A46B 9/023

See application file for complete search history.

(56) References Cited

FOREIGN PATENT DOCUMENTS

| | | | |
|---|---|---|---|
| CN | 201591248 U | | 9/2010 |
| JP | 3846002 B2 | * | 11/2006 |
| KR | 101785698 B1 | | 10/2017 |

OTHER PUBLICATIONS

Search Report for Application No. 20180646.0-1011 dated Apr. 12, 2020.

* cited by examiner

*Primary Examiner* — Shay Karls
(74) *Attorney, Agent, or Firm* — Demian K. Jackson; Jackson IPG PLLC

(57) ABSTRACT

An improvement of hair brush structure includes a brush head, a handle, and an adjustment device interconnected to the brush head and the handle. A repeated rotation of the adjustment device causes changing an appearance of the hair brush.

12 Claims, 14 Drawing Sheets

HAIR BRUSH STRUCTURE

BACKGROUND OF THE INVENTION

1. Field of the Invention

The invention relates to improvements of a hair brush structure and more particularly to a hair brush utilizing a simple structure and a rotational or push-pull operation to quickly changing a diameter of a brush head and appearance thereof.

2. Description of Related Art

A conventional hair brush capable of adjusting a diameter of its brush head is shown in FIGS. 14A and 14B. It mainly utilizes a plurality of cams of different diameters arranged in different relative positions so that the brush head has different appearances (e.g., conic appearance or spherical appearance) by having different combinations of the cams. However, for changing the appearance of the brush head, it is required to detach the brush head, remove the cams from the brush head, change the positions of combinations of the cams, and assemble these components again. Its operation is very inconvenient.

Thus, the need for improvement still exists.

SUMMARY OF THE INVENTION

It is one object of the invention to provide an improvement of hair brush structure and more particularly to a hair brush utilizing a simple combination of component to quick change a diameter of a brush head and appearance thereof.

According to an embodiment of the present invention, wherein the hollow cylinder of the internal locking device includes an flat connection member at one end, and a positioning cavity at one end of each guide groove adjacent to the flat connection member; and wherein the rotation of the adjustment device causes the guide rods to enter the positioning cavities, thereby locking the guide rods in the positioning cavities with movement being not allowed.

According to an embodiment of the present invention, wherein the internal locking device and the support shaft are fitted together, the internal locking device and the support shaft are inserted into the adjustment device, the brush head includes a bending body having a plurality of holes at one end, and the internal locking device includes an outward extending flat connection member at one end of the hollow cylinder and a plurality of corresponding projections adapted to complimentarily fasten in the holes so as to fasten the brush head.

According to an embodiment of the present invention, wherein the adjustment device includes the inner channel having the threads, an outer member having a bottom formed with one end of the outer member, and an annular gap between open other ends of the inner channel and the outer member so that the projections are adapted to pass through the holes into the annular gap to fasten a bottom of the brush head in the annular gap.

According to an embodiment of the present invention, wherein the other end of the internal locking device is disposed in a receptacle of the handle so that the adjustment device is disposed between the brush head and the handle.

Another aspect of the present invention is a hair brush structure, comprising: a brush head; a handle; and an adjustment device interconnected to the brush head and the handle; wherein the brush head has one end attached to an internal locking device, the internal locking device is disposed in the adjustment device and includes a hollow cylinder with a support shaft disposed therein, the support shaft is inserted into the brush head and secured to a top of the brush head, the internal locking device and the support shaft are fitted together, the internal locking device further comprises an outward extending flat connection member at one end of the hollow cylinder, the flat cylinder, the central hole having two opposite recesses and two opposite extending grooves adjacent to the recesses respectively, the support shaft includes two guide rods corresponding to the recesses respectively, and in response to moving the adjustment device by moving the internal locking device and by utilizing the flat connection member, the guide rods of the support shaft pass through the recesses of the central hole to enter the extending grooves, thereby changing an appearance of the hair brush.

According to an embodiment of the present invention, further comprising a positioning cavity at one end of each extending groove wherein in response to moving the internal locking device by rotating the adjustment device, the guide rods enter the positioning cavities communicating with the extending grooves, thereby locking the guide rods in the positioning cavities with movement being not allowed.

According to an embodiment of the present invention, wherein the internal locking device is disposed in the adjustment device, the brush head includes a bending body having a plurality of holes at one end, and the flat connection member further comprises a plurality of corresponding projections adapted to complimentarily insert through the holes of the brush head, thereby fastening the brush head.

According to an embodiment of the present invention, wherein the adjustment device includes an inner channel, an outer member having a bottom formed with one end of the outer member, and an annular gap between open ends of the inner channel and the outer member so that the projections are adapted to pass through the holes into the annular gap to fasten a bottom of the brush head in the annular gap.

According to an embodiment of the present invention, wherein the support shaft further comprises an enlarged lower member fastened in a receptacle of the handle.

According to an embodiment of the present invention, wherein the brush head further comprises a through hole at the other end, further comprising a rod-shaped fastener adapted to pass through the through hole of the brush head to insert into one end of the support shaft, thereby securing the top of the brush head to the end of the support shaft.

The invention has the following advantageous effects: It utilizes the adjustment member to change an appearance of the hair brush structure from sphere to oval or vice versa. Thus, the user may have one of many different styles on the hair.

The above and other objects, features and advantages of the invention will become apparent from the following detailed description taken with the accompanying drawings.

DETAILED DESCRIPTION OF THE INVENTION

Referring to FIGS. 1 to 8, a hair brush 1 in accordance with a first embodiment of the invention comprises a brush head 10, a handle 20, and an adjustment device 30 interconnected to the brush head 10 and the handle 20 as discussed in detail below.

Figure 1:
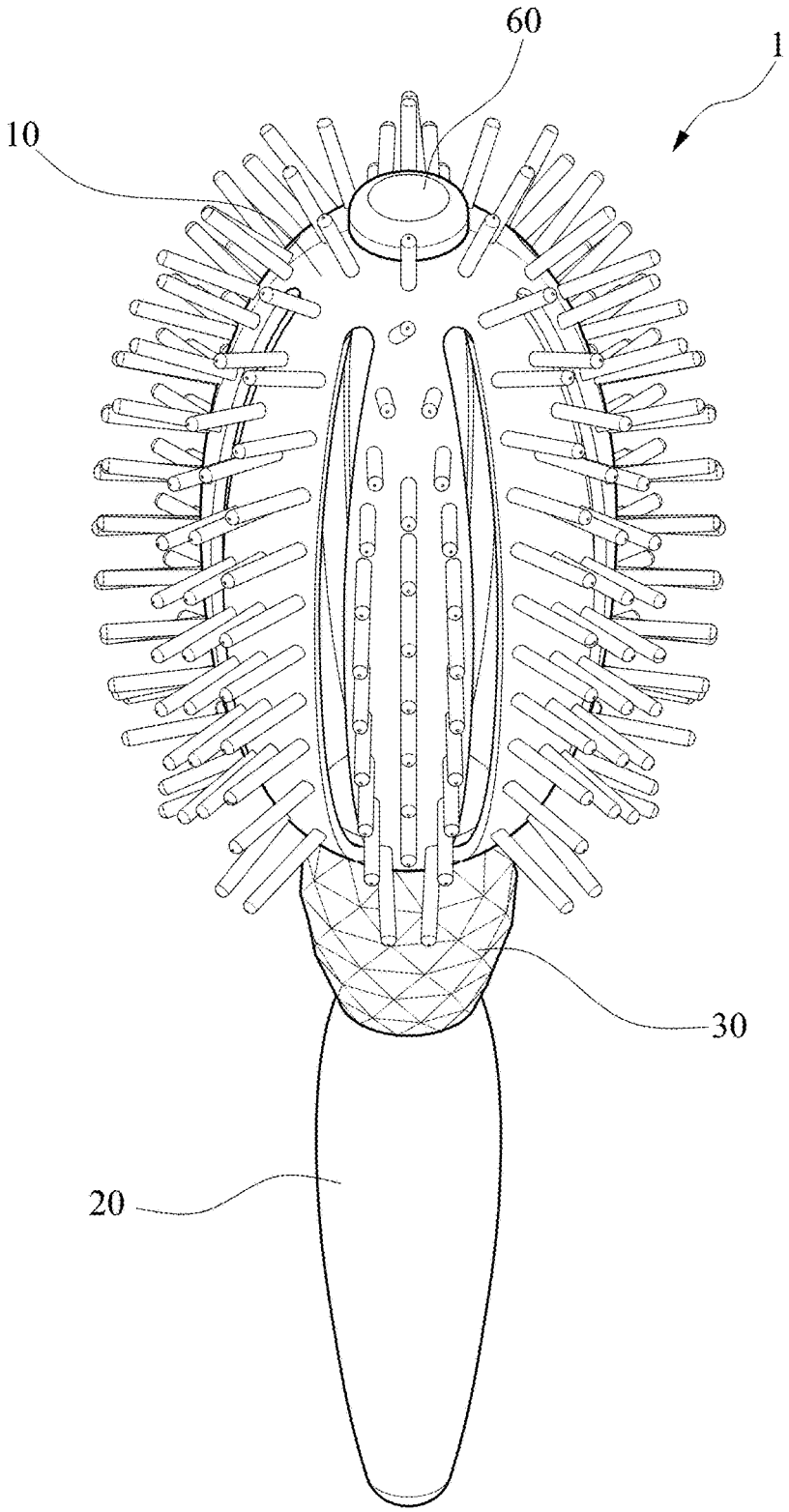
FIG. 1 is a perspective view of a hair brush according to a first preferred embodiment of the invention.
Figure 2:
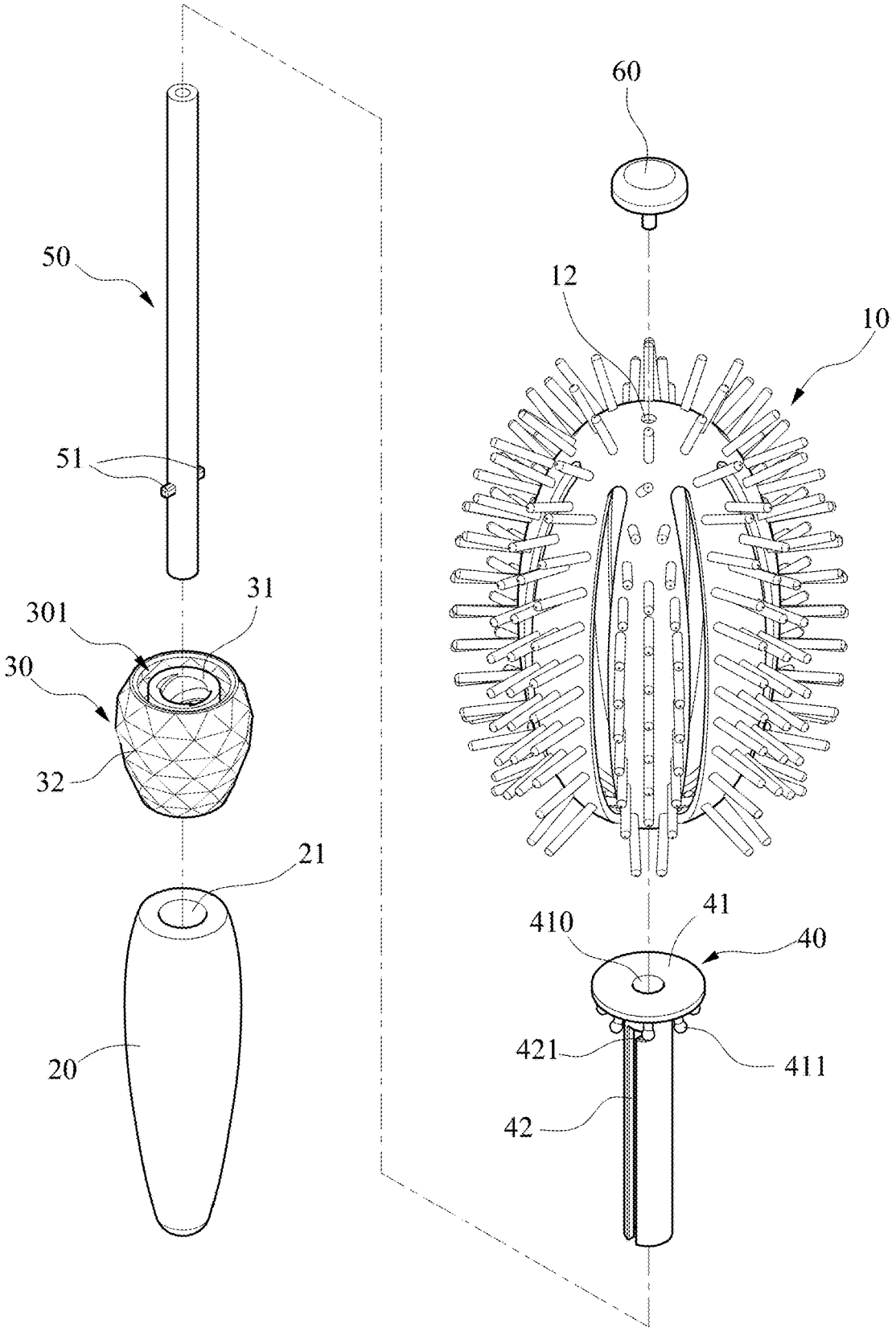
FIG. 2 is an exploded view of the hair brush.
Figure 3:
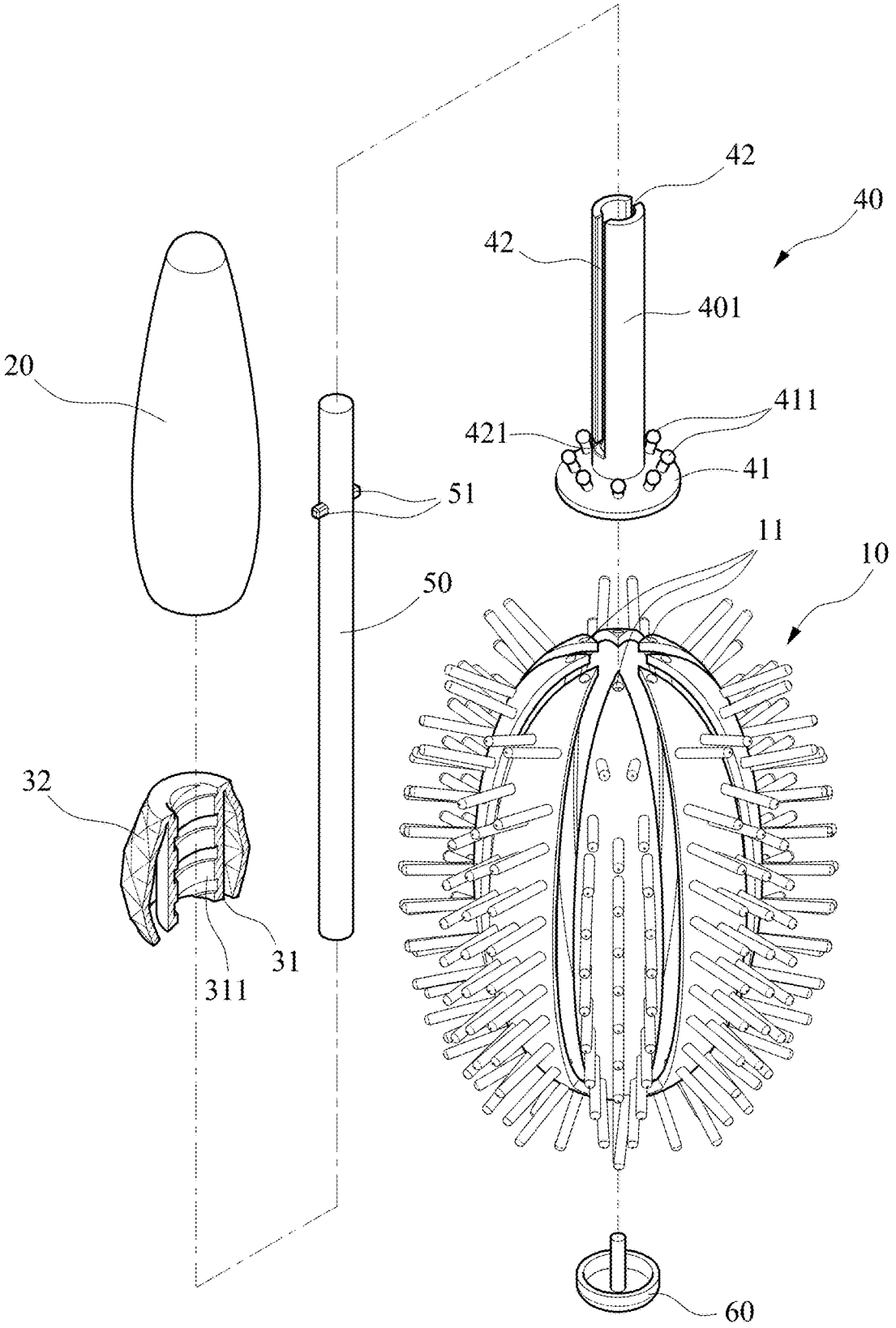
FIG. 3 is another exploded view of the hair brush.

As shown in FIGS. 2 and 3, the brush head 10 includes a bending body having a plurality of holes 11 at one end for attaching to an internal locking device 40. The internal locking device 40 includes a hollow cylinder 401, an outward extending flat connection member 41 at one end of the hollow cylinder 401 and a central hole 410 communicating with inside of the hollow cylinder 401. When the brush head 10 is bent, a plurality of corresponding projections 411 adapted to complimentarily fasten in the holes 11 and a bottom of the brush head 10 is secured to the internal locking device 40.

The internal locking device 40 further comprise two opposite guide grooves 42 on the hollow cylinder 401, and a positioning cavity 421 at one end of the guide groove 42 adjacent to the flat connection member 41. The guide groove 42 and the positioning cavity 421 contact together are shaped as an "L" (see FIGS. 5B and 6B).

The hair brush 1 further comprises a support shaft 50 including two opposite guide rods 51 proximate at one end, the guide rods 51 being moveably disposed in the guide grooves 42 of the internal locking device 40 so as one end of the support shaft 50 can be inserted into the hollow cylinder 401 by moving the guide rods 51 along the guide grooves 42. Thus the other end of the support shaft 50 can be disposed in the brush head 10 by passing through the central hole 410. After the brush head 10 has been bent, the brush head 10 has a through hole 12 at the top end, and a rod-shaped fastener 60 can pass through the through hole 12 to insert into the top end of the support shaft 50. Thus, the top of the brush head 10 and the top end of the support shaft 50 are fastened together.

Figure 4:
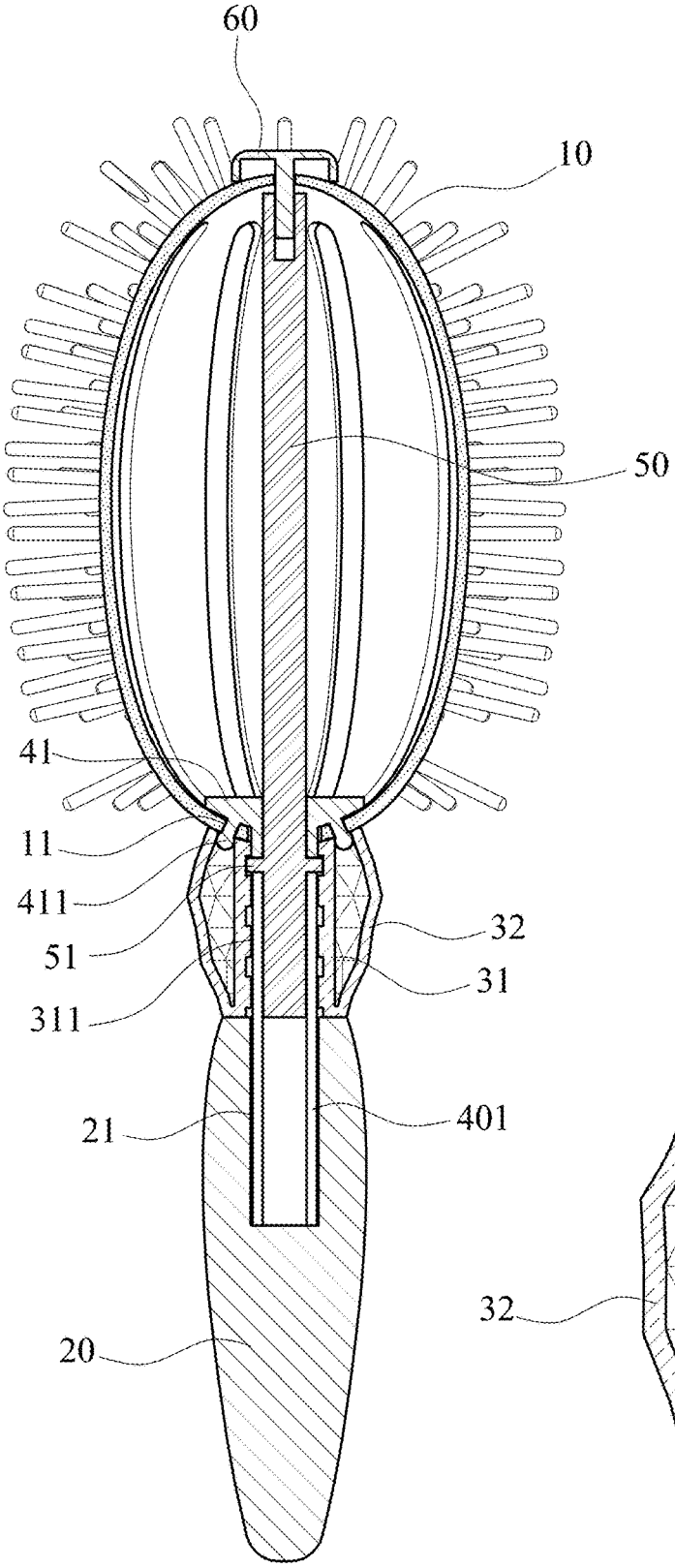
FIG. 4 is a longitudinal sectional view of the hair brush.

One end of the internal locking device 40 is connected to the brush head 10 and is fitted together with the support shaft 50. Thereafter, the internal locking device 40 and the support shaft 50 are inserted into the adjustment device 30. As shown in FIG. 4, the other end of the internal locking device 40 is disposed in a receptacle 21 of the handle 20, and the adjustment device 30 is mounted between the brush head 10 and the handle 20.

Figure 4A:
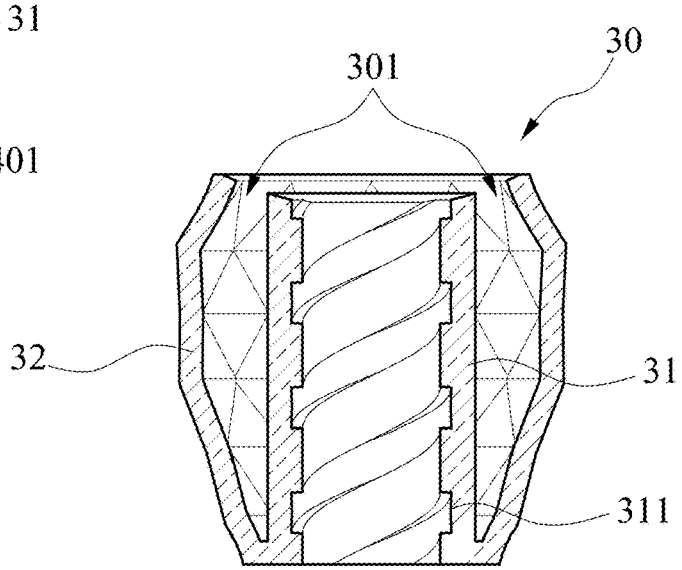
FIG. 4A is a longitudinal sectional view of the adjustment member of the hair brush.

As shown in FIG. 4A, the adjustment device 30 includes an inner channel 31 having threads 311, and an outer member 32. The bottom end of the inner channel 31 formed with one end of the outer member 32. The other end of the outer member 32 is communicated to external and the inner channel 31 is surrounded by the outer member 32. As shown in FIG. 2, the adjustment device 30 includes an annular gap 301 between the top ends of the inner channel 31 and the outer member 32, to enable the projections 411 of the flat connection member 41 of the internal locking device 40 pass through the holes 11 to fasten in the annular gap 301 of the adjustment device 30, as shown in FIG. 4. At the same time, the bottom of the bent brush head 10 is fastened in the annular gap 301 and the internal locking device 40 is fastened in the adjustment device 30.

Figure 5A:
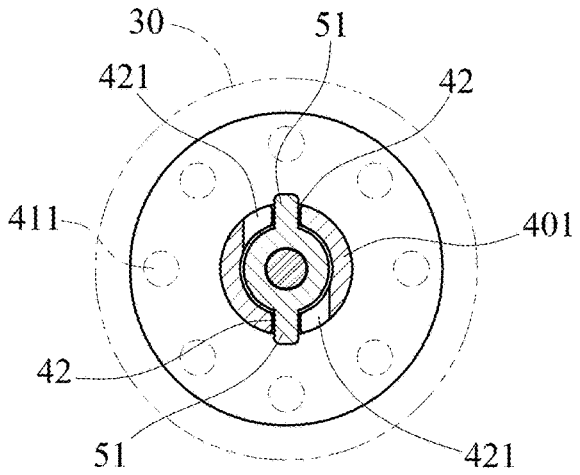
FIG. 5A schematically depicts a unlocked state of the hair brush.
Figure 6A:
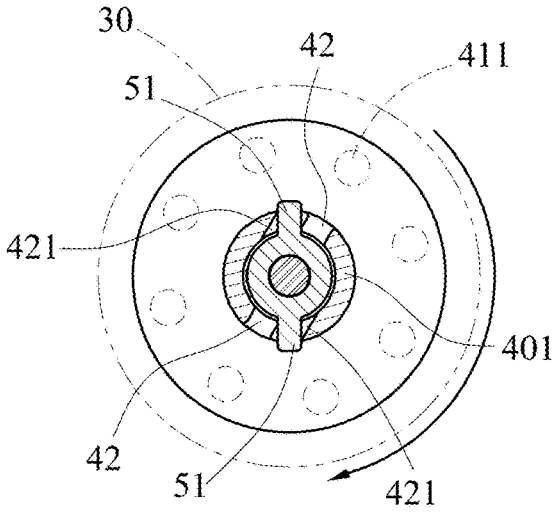
FIG. 6A schematically depicts a locked state of the hair brush.
Figure 5B:
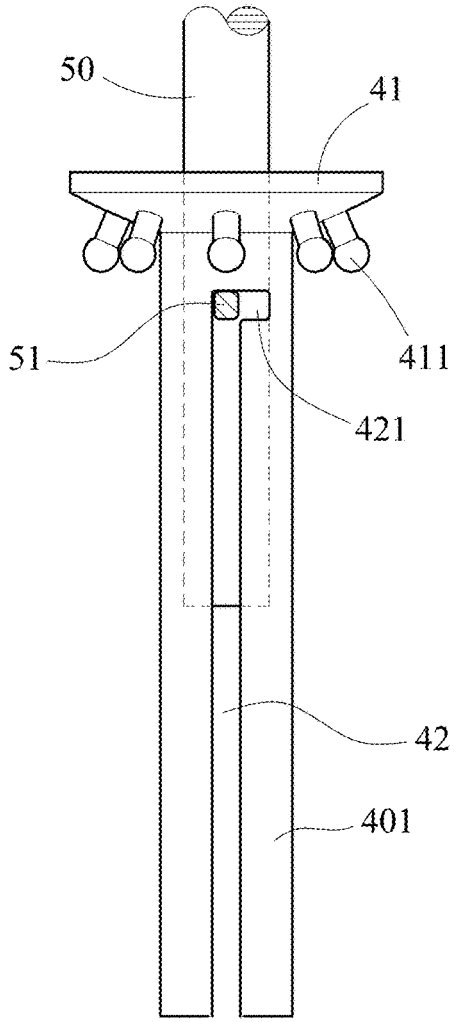
FIG. 5B is a sectional view of FIG. 5A.
Figure 6B:
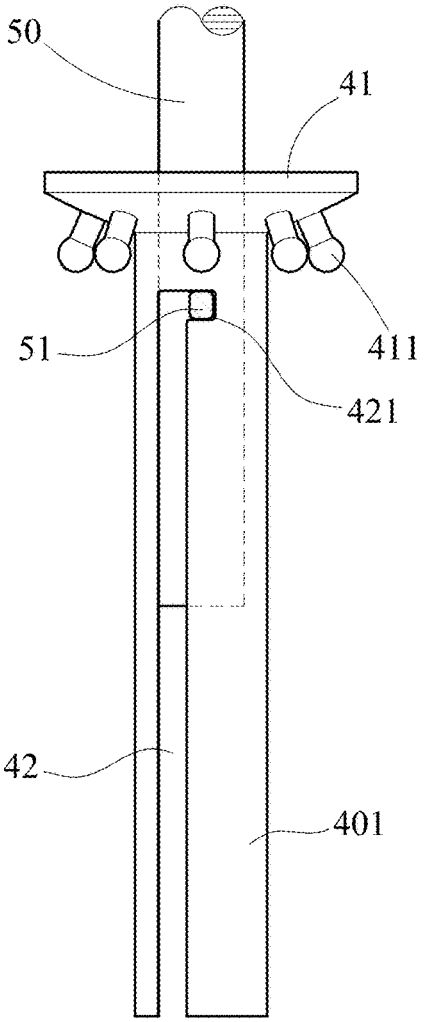
FIG. 6B is a sectional view of FIG. 6A.

In assembly, the guide rods 51 of the support shaft 50 nested into the guide grooves 42 of the hollow cylinder 401 to dispose the support shaft 50 in the internal locking device 40. As shown in FIGS. 5A and 5B in conjunction with FIGS. 6 and 6B, in use for keeping the hair brush 1 as the structure of FIG. 4, the adjustment device 30 can be rotated to turn the threads 311 of the inner channel 31 to guide the guide rods 51 move to enter into the positioning cavities 421 at the ends of the guide grooves 42. The guide rods 51 are locked in the positioning cavities 421 with movement not allowed. As a result, the brush head 10 can be kept for use as the oval shape of FIG. 4.

Figure 7:
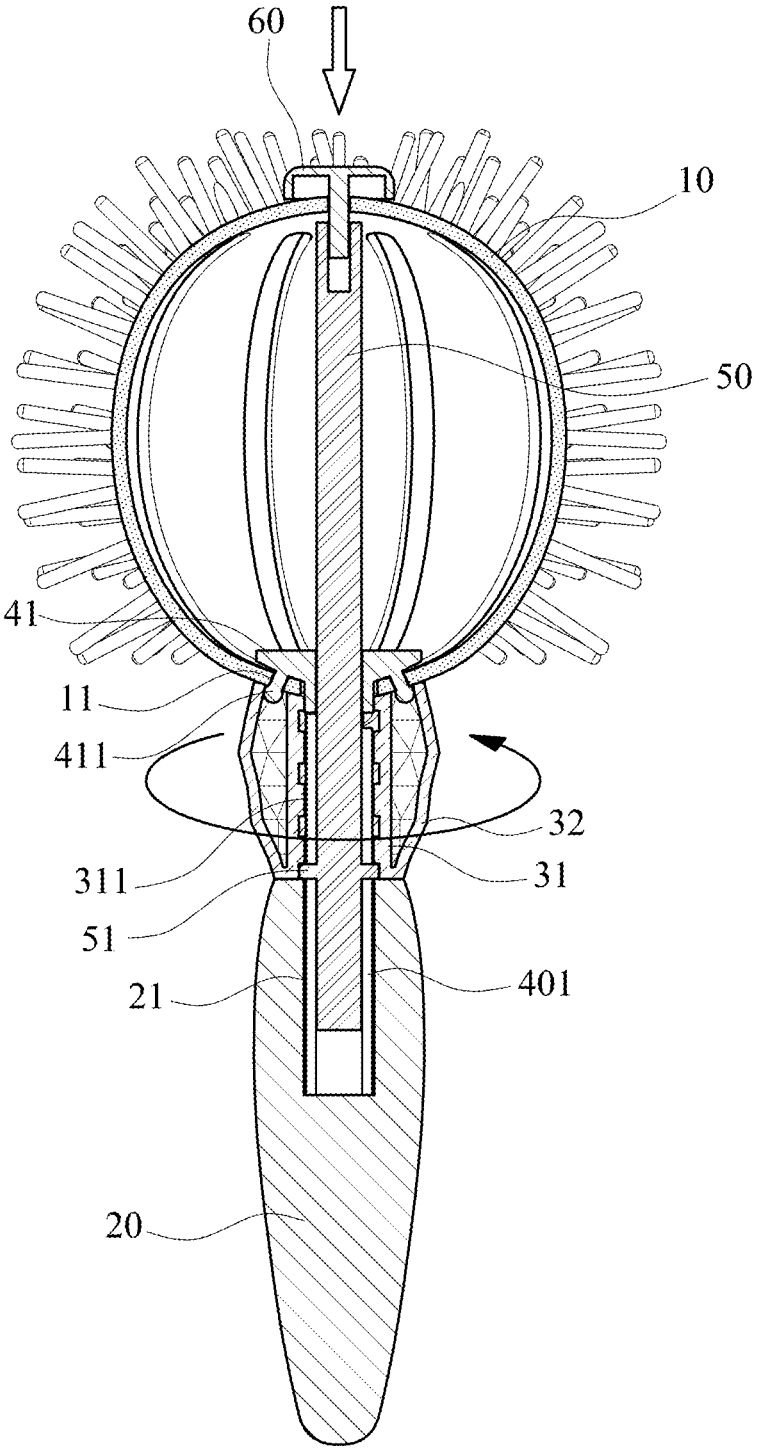
FIG. 7 schematically depicts an operation of the hair brush.
Figure 8:
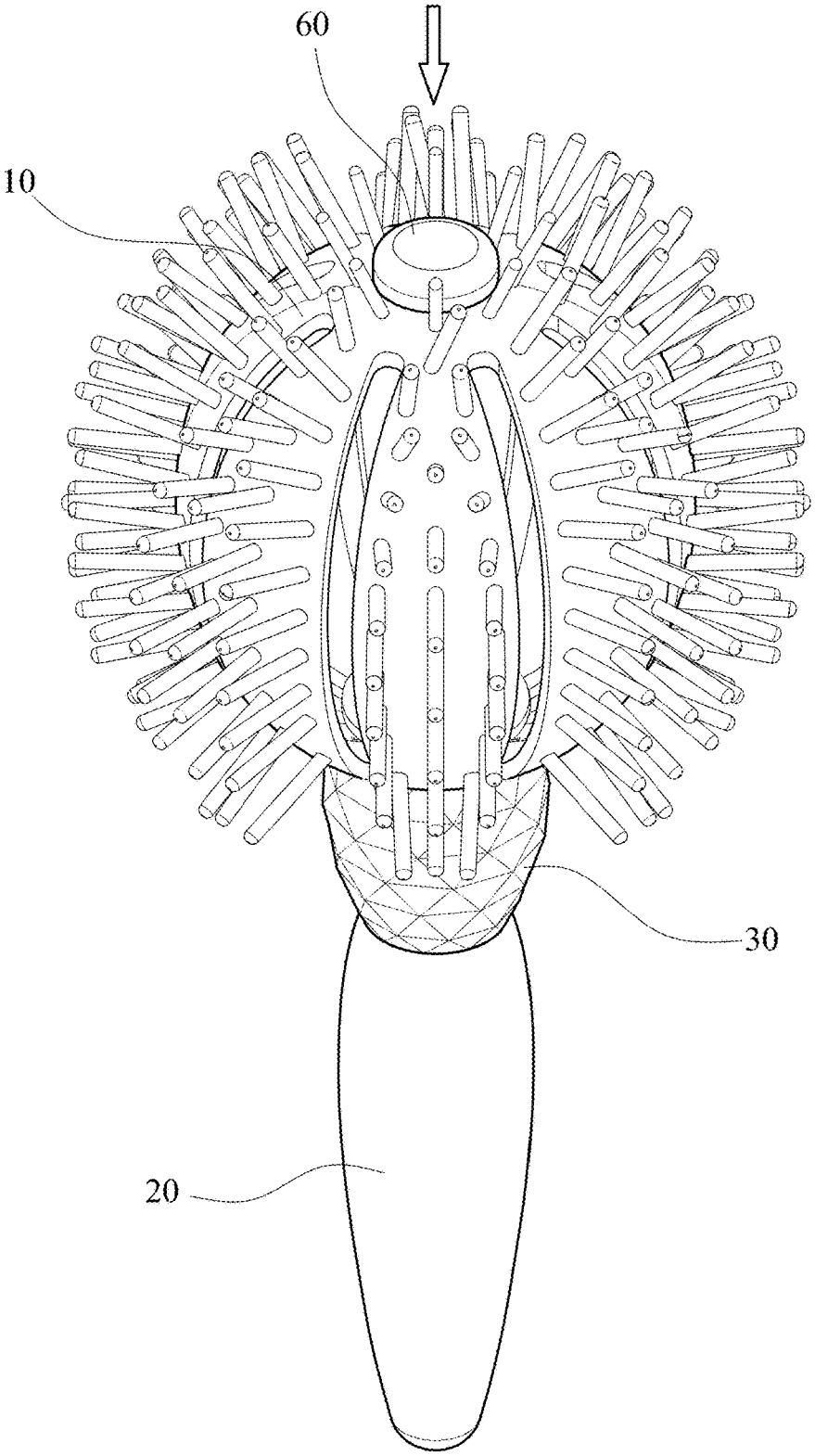
FIG. 8 is another perspective view of the hair brush showing the different appearance.
Figure 9:
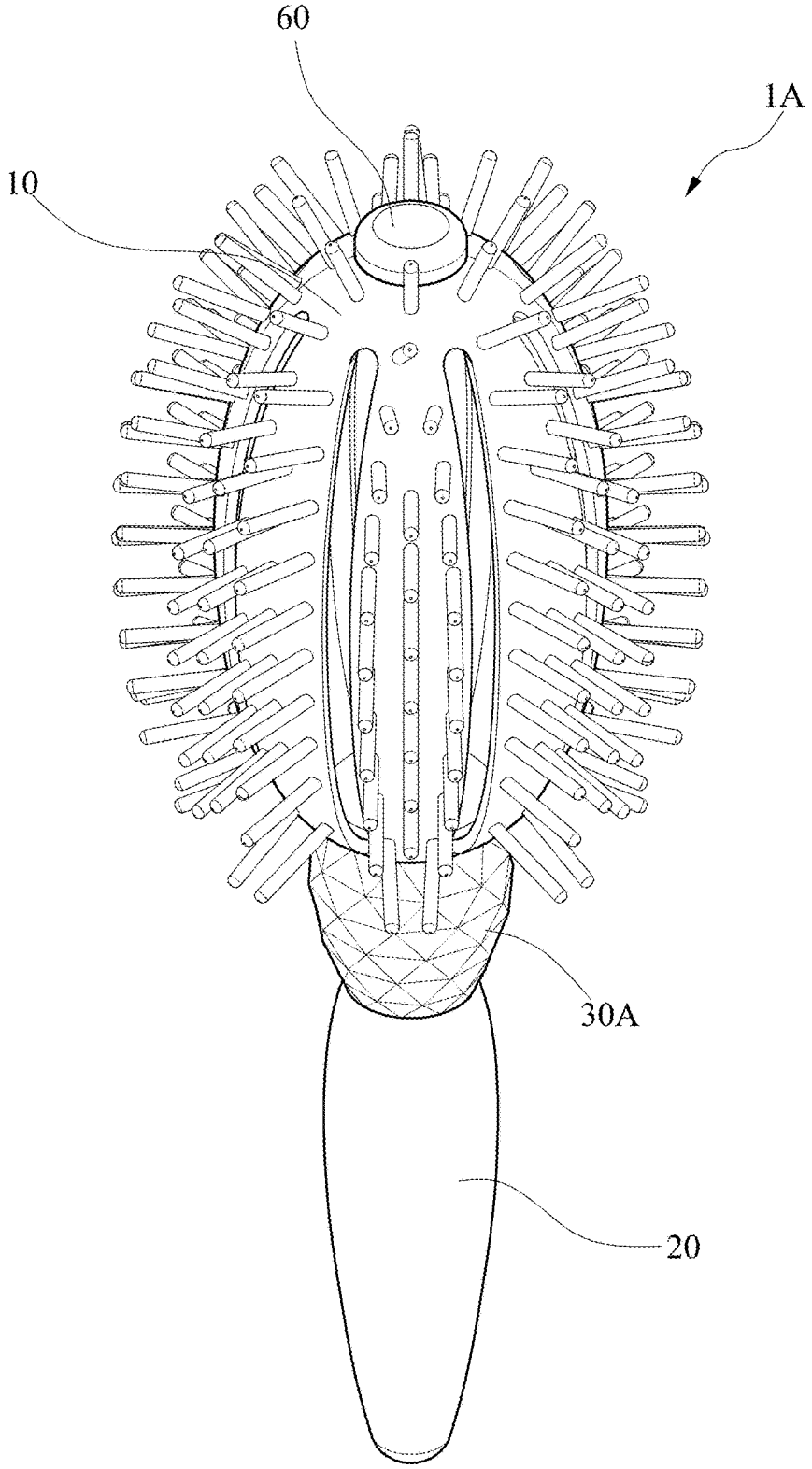
FIG. 9 is a perspective view of a hair brush according to a second preferred embodiment of the invention.

Moreover, the hair brush 1 may be shaped as the sphere structure for use of FIG. 7. In detail, the adjustment device 30 is rotated repeatedly to cause the threads 311 of the inner channel 31 to move the guide rods 51. Thus, a use state of the hair brush 1 is changed by moving the guide rods 51 along the guide grooves 42 and the threads 311 in desired direction. If the adjustment device 30 is rotated counterclockwise, as shown in FIG. 7, the guide rods 51 move downwardly. And in turn, the support shaft 50 moves to a blind bottom of the receptacle 21 relative to the hollow cylinder 401.

The rod-shaped fastener 60 is used to fasten the brush head 10 and the support shaft 50 together. When a downward movement of the support shaft 50, the top of the brush head 10 also move downwardly. As the bottom of the brush head 10 is secured to the adjustment device 30, the downward movement of the support shaft 50 presses the brush head 10, and the shape of the brush head 10 is changed as a sphere for use (see FIG. 8).

In addition, regarding, a rotation of the adjustment device 30 may move the guide rods 51 to the guide grooves 42. To rotate the adjustment device 30 in an opposite direction to change the brush head 10 of the hair brush 1 from the sphere state as shown in FIG. 7 to the original states as FIGS. 1 and 4. As one end, the user may use the hair brush 1 to curl the hair into one of many different styles.

Referring to FIGS. 9 to 13, a hair brush 1A in accordance with a second preferred embodiment of the invention is shown. The same components are labeled with the same reference characters and its description is omitted herein for the sake of brevity.

The characteristics of the second embodiment are substantially the same as that of the first preferred embodiment except the following: the hair brush 1A includes an adjustment device 30A which is interconnected to the brush head 10 and the handle 20. The adjustment device 30A includes an outer member 32 and an inner channel 31A which does not have internal threads 311 of the first embodiment.

Figure 10:
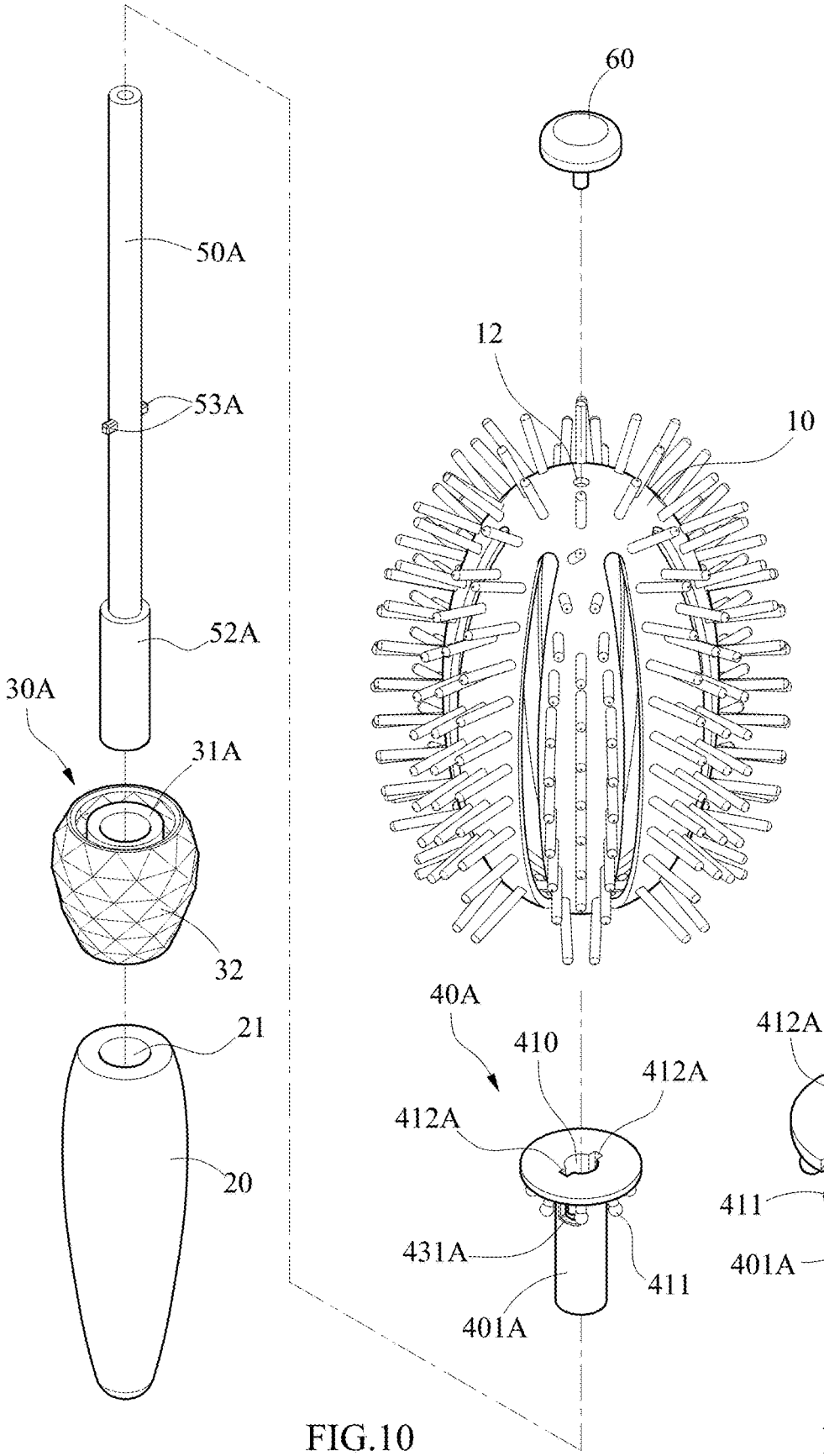
FIG. 10 is an exploded view of the hair brush of the second embodiment.
Figure 10A:
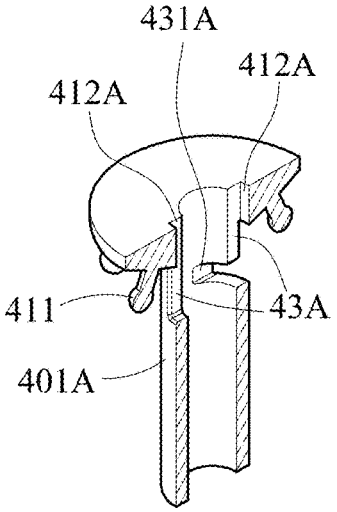
FIG. 10A is a longitudinal sectional view of the internal locking member of hair brush of the second embodiment.

The bottom of the brush head 10 is secured to an internal locking device 40A of the hair brush 1A. The internal locking device 40A has a hollow cylinder 401A, an flat connection member 41 at one end of the hollow cylinder 401A and having a central hole 410 communicating with inside of the hollow cylinder 401A, the central hole 410 having two opposite recesses 412A. As shown in FIG. 10A, under the flat connection member 41, the hollow cylinder 401A includes two opposite extending grooves 43A directly below the corresponding recesses 412A respectively. One end of the extending groove 43A is provided with a positioning cavity 431A.

A support shaft 50A of the hair brush 1A includes an enlarged lower member 52A fastened in the receptacle 21 of the handle 20. Two opposite guide rods 53A are formed on an upper portion of the support shaft 50A above the enlarged lower member 52A. The guide rods 53A of the support shaft 50A correspond to the opposite recesses 412A of the central hole 410 respectively so that the guide rods 53A of the support shaft 50A may pass through the opposite recesses 412A.

Figure 11:
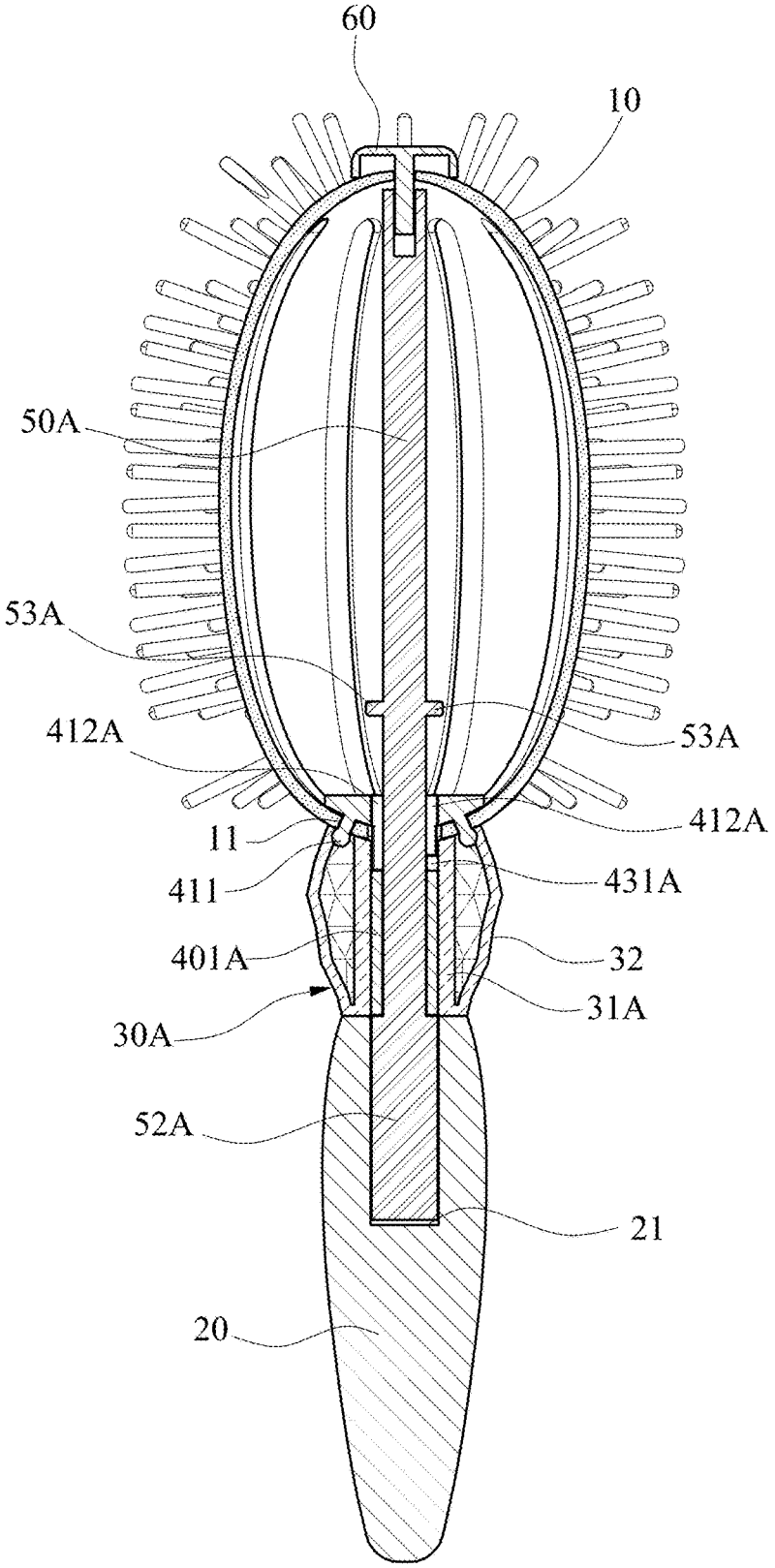
FIG. 11 is a longitudinal sectional view of the hair brush of the second embodiment.
Figure 12:
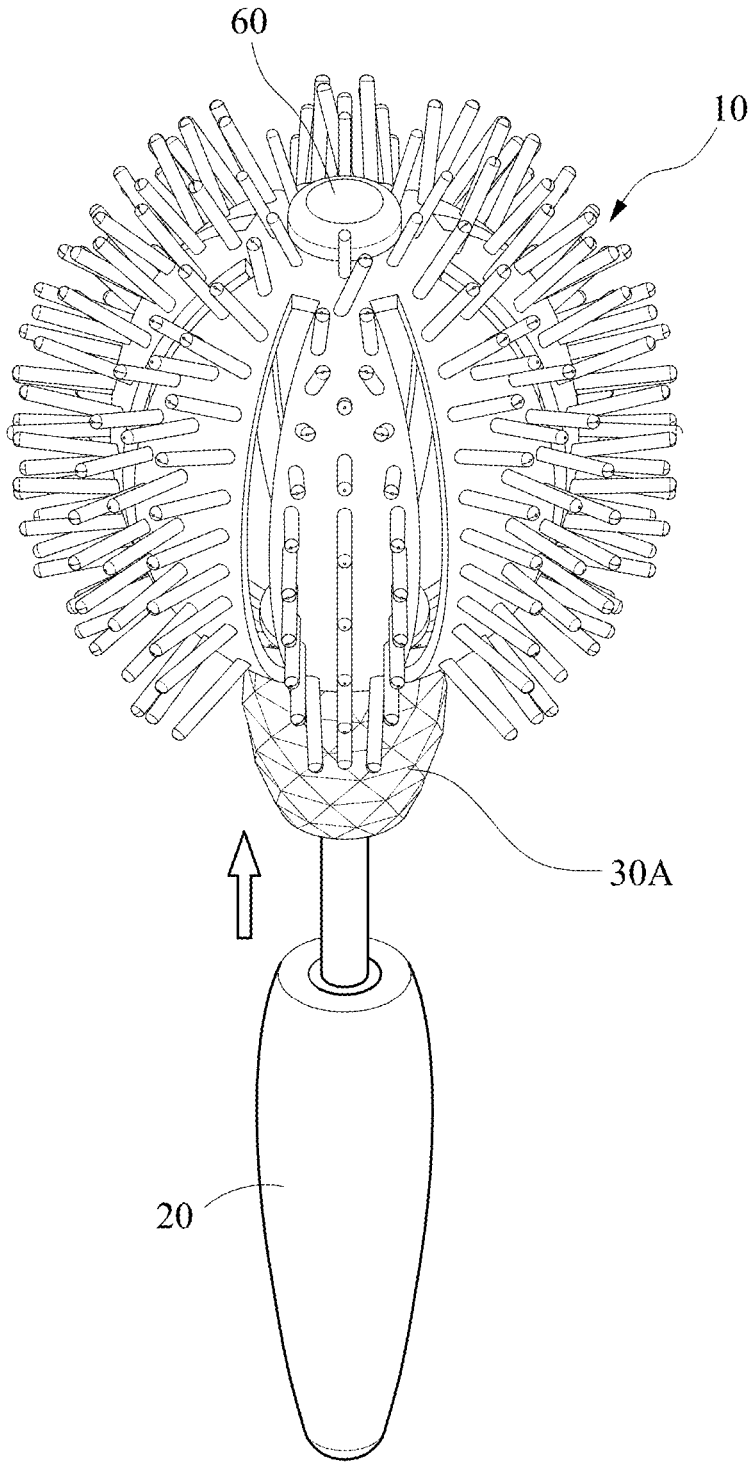
FIG. 12 schematically depicts an operation of the hair brush of the second embodiment.
Figure 13:
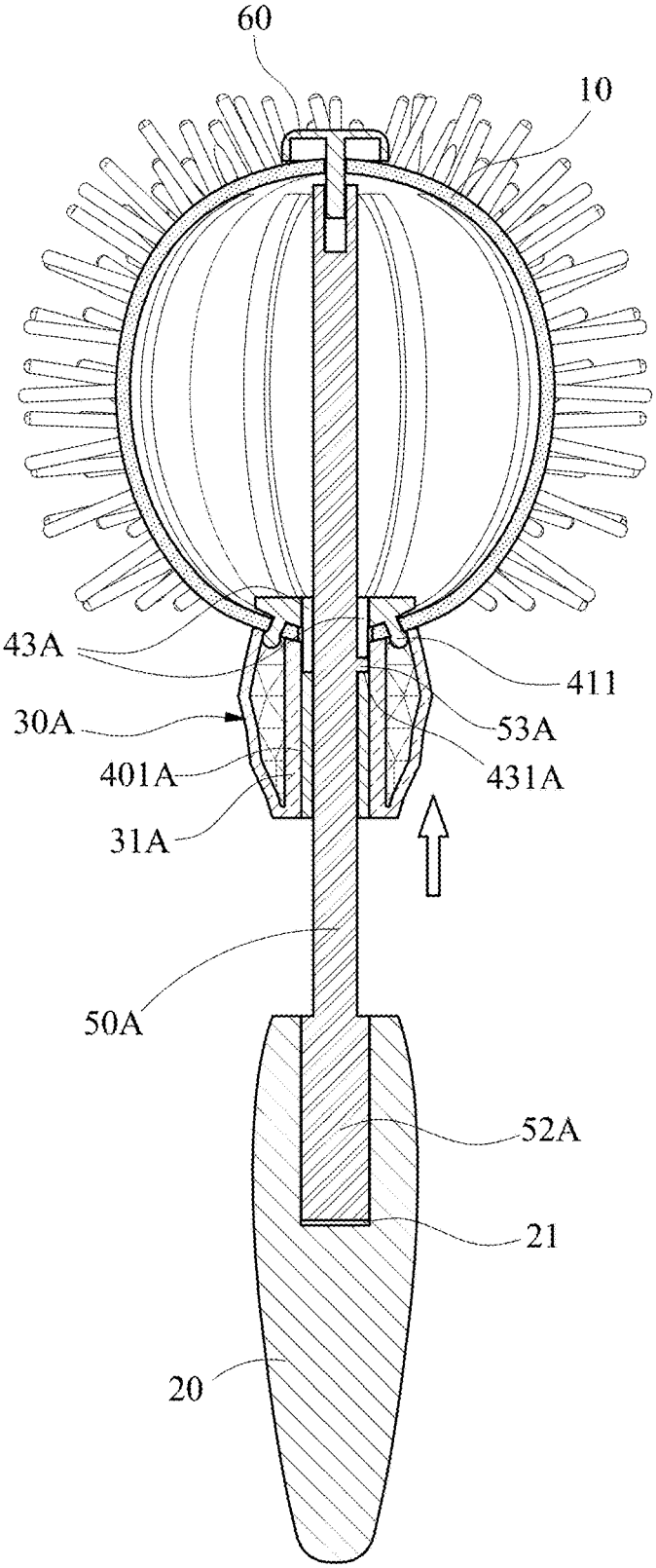
FIG. 13 is a longitudinal sectional view of FIG. 12.
Figure 14A:
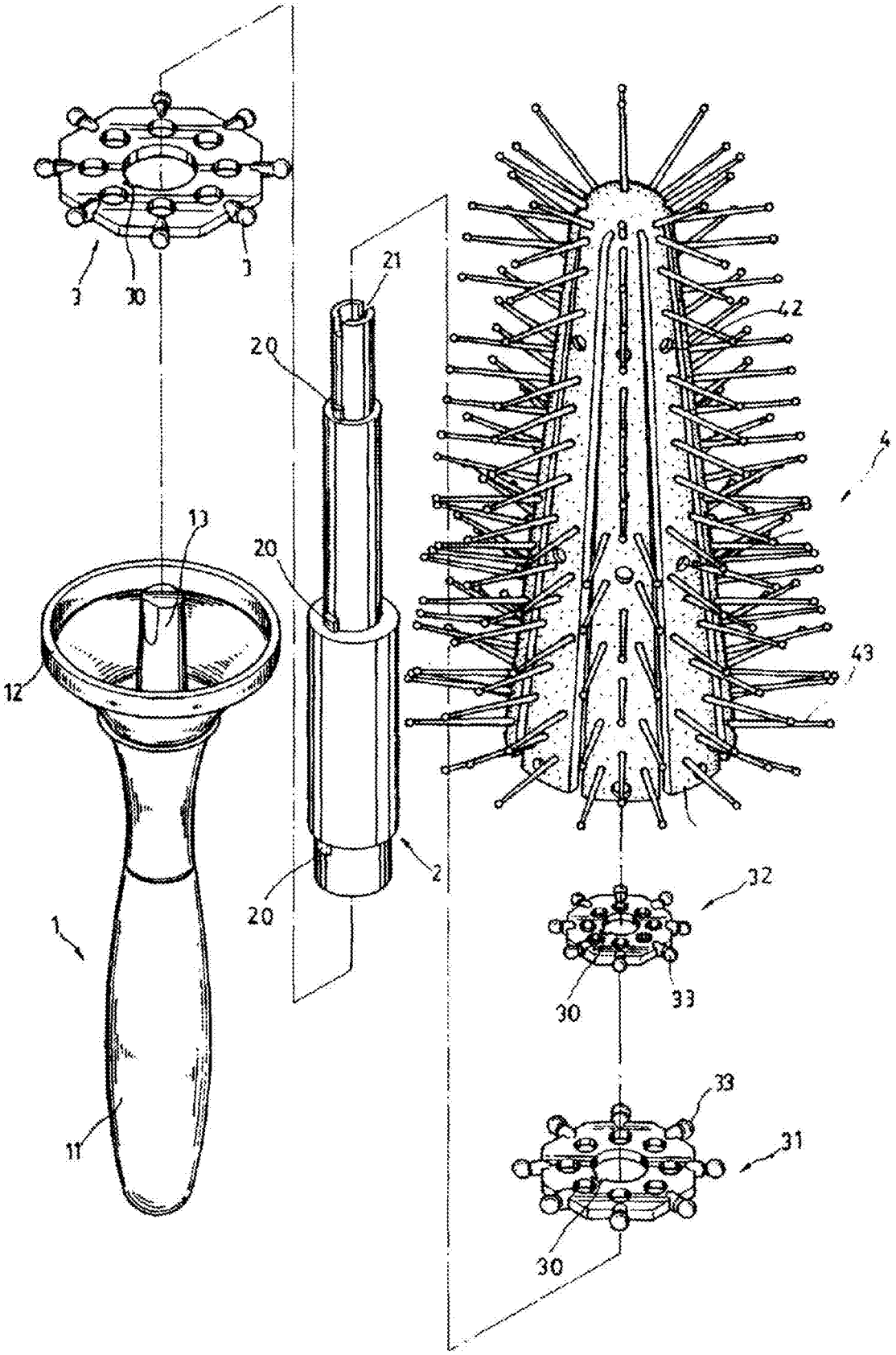
FIG.14A ( Prior Art )
FIG. 14A is an exploded view of a conventional hair brush.
Figure 14B:
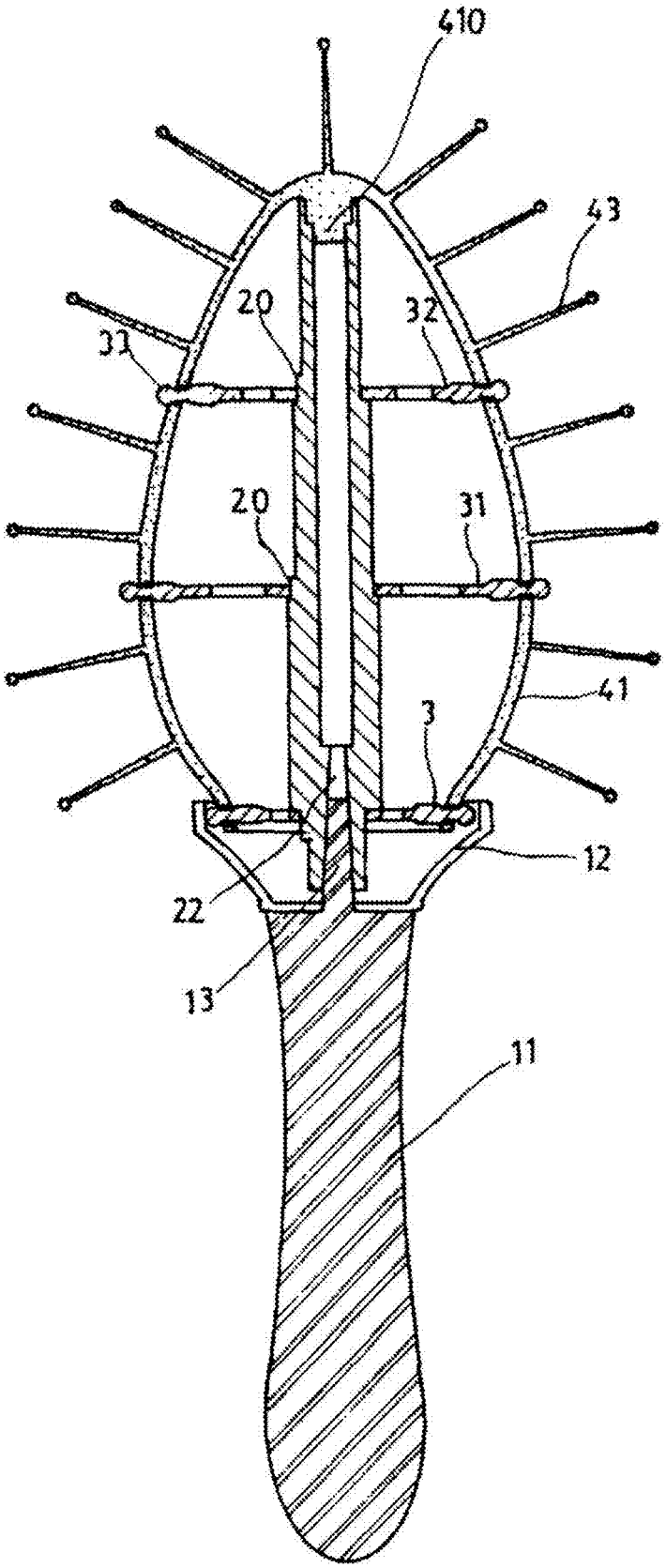
FIG.14B ( Prior Art )
FIG. 14B is a longitudinal sectional view of the conventional hair brush.

The hair brush 1A of the second embodiment may be in an oval use state of FIG. 11 or a sphere use state of FIGS. 12 and 13. As shown in FIG. 13, the adjustment device 30A is secured onto the internal locking device 40A. Thus, an upward movement of the adjustment device 30A may also move the internal locking device 40A upward. As shown in FIG. 13, by utilizing the flat connection member 41, the guide rods 53A of the support shaft 50A may pass through the opposite recesses 412A of the central hole 410 of the flat connection member 41 to enter the lower extending grooves 43A.

In use, for keeping the hair brush 1A in the structure of FIG. 13, the adjustment device 30A can be rotated to move the internal locking device 40A so that the lower member 52A can be locked by the positioning cavities 431A communicating with the extending groove 43A. Thus, the guide rods 53A are not allowed to move upward or downward. As a result, the brush head 10 can be kept as the spherical shape of FIG. 12 for use.

Moreover, regarding the hair brush 1A, a rotation of the adjustment device 30A may move the guide rods 53A into the extending grooves 43A. A reverse downward movement of the adjustment device 30A returns the brush head 10 from the sphere state of FIG. 12 to the oval state of FIG. 9.

While the invention has been described in terms of preferred embodiments, those skilled in the art will recognize that the invention can be practiced with modifications within the spirit and scope of the appended claims.

What is claimed is:

1. An improvement of hair brush structure, comprising:

a brush head;

a handle; and an adjustment device interconnected to the brush head and the handle;

wherein the brush head has one end attached to an internal locking device, the internal locking device is disposed in the adjustment device and includes a hollow cylinder with a support shaft disposed therein, the support shaft is inserted into the brush head and secured to a top of the brush head, the internal locking device further comprises two opposite guide grooves on the hollow cylinder, the support shaft includes two opposite guide rods moveably disposed in the guide grooves respectively, and the adjustment device includes an inner channel having threads so that a repeated rotation of the adjustment device causes the threads of the inner channel to move the guide rods along the guide grooves and compress the top of the hair brush, thereby changing an appearance of the hair brush.

2. The improvement of hair brush structure of claim 1, wherein the hollow cylinder of the internal locking device includes an flat connection member at one end, and a positioning cavity at one end of each guide groove adjacent to the flat connection member; and wherein the rotation of the adjustment device causes the guide rods to enter the positioning cavities, thereby locking the guide rods in the positioning cavities with movement being not allowed.

3. The improvement of hair brush structure of claim 1, wherein the internal locking device and the support shaft are fitted together, the internal locking device and the support shaft are inserted into the adjustment device, the brush head includes a bending body having a plurality of holes at one end, and the internal locking device includes an outward extending flat connection member at one end of the hollow cylinder and a plurality of corresponding projections adapted to complimentarily fasten in the holes so as to fasten the brush head.

4. The improvement of hair brush structure of claim 3, wherein the adjustment device includes the inner channel having the threads, an outer member having a bottom formed with one end of the outer member, and an annular gap between open other ends of the inner channel and the outer member so that the projections are adapted to pass through the holes into the annular gap to fasten a bottom of the brush head in the annular gap.

5. The improvement of hair brush structure of claim 1, wherein the other end of the internal locking device is disposed in a receptacle of the handle so that the adjustment device is disposed between the brush head and the handle.

6. The improvement of hair brush structure of claim 1, wherein the brush head further comprises a through hole at the other end, further comprising a rod-shaped fastener adapted to pass through the through hole of the brush head to insert into one end of the support shaft, thereby securing the top of the brush head to the end of the support shaft.

7. An improvement of hair brush structure, comprising:

a brush head;

a handle; and an adjustment device interconnected to the brush head and the handle;

wherein the brush head has one end attached to an internal locking device, the internal locking device is disposed in the adjustment device and includes a hollow cylinder with a support shaft disposed therein, the support shaft is inserted into the brush head and secured to a top of the brush head, the internal locking device and the support shaft are fitted together, the internal locking device further comprises an outward extending flat connection member at one end of the hollow cylinder, the flat connection member including a central hole communicating with inside of the hollow cylinder, the central hole having two opposite recesses and two opposite extending grooves adjacent to the recesses respectively, the support shaft includes two guide rods corresponding to the recesses respectively, and in response to moving the adjustment device by moving the internal locking device and by utilizing the flat connection member, the guide rods of the support shaft pass through the recesses of the central hole to enter the extending grooves, thereby changing an appearance of the hair brush.

8. The improvement of hair brush structure of claim 7, further comprising a positioning cavity at one end of each extending groove wherein in response to moving the internal locking device by rotating the adjustment device, the guide rods enter the positioning cavities communicating with the extending grooves, thereby locking the guide rods in the positioning cavities with movement being not allowed.

9. The improvement of hair brush structure of claim 7, wherein the internal locking device is disposed in the adjustment device, the brush head includes a bending body having a plurality of holes at one end, and the flat connection member further comprises a plurality of corresponding projections adapted to complimentarily insert through the holes of the brush head, thereby fastening the brush head.

10. The improvement of hair brush structure of claim 9, wherein the adjustment device includes an inner channel, an outer member having a bottom formed with one end of the outer member, and an annular gap between open ends of the inner channel and the outer member so that the projections are adapted to pass through the holes into the annular gap to fasten a bottom of the brush head in the annular gap.

11. The improvement of hair brush structure of claim 7, wherein the support shaft further comprises an enlarged lower member fastened in a receptacle of the handle.

12. The improvement of hair brush structure of claim 7, wherein the brush head further comprises a through hole at the other end, further comprising a rod-shaped fastener adapted to pass through the through hole of the brush head to insert into one end of the support shaft, thereby securing the top of the brush head to the end of the support shaft.

* * * * *